US008567904B2

(12) United States Patent
Toyama

(10) Patent No.: US 8,567,904 B2
(45) Date of Patent: Oct. 29, 2013

(54) LIQUID ABSORPTION MEMBER AND PRINTER INCLUDING LIQUID ABSORPTION MEMBER

(75) Inventor: Hisashi Toyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/422,160

(22) Filed: Mar. 16, 2012

(65) Prior Publication Data

US 2012/0236073 A1 Sep. 20, 2012

(30) Foreign Application Priority Data

Mar. 17, 2011 (JP) ..... 2011-059066

(51) Int. Cl.
*B41J 2/165* (2006.01)
*B41J 2/185* (2006.01)

(52) U.S. Cl.
USPC ..... 347/36

(58) Field of Classification Search
USPC ..... 347/36
See application file for complete search history.

(56) References Cited

U.S. PATENT DOCUMENTS

| | | | | | |
|---|---|---|---|---|---|
| 1,507,372 | A * | 9/1924 | Greenstreet | 428/181 |
| 2,305,923 | A * | 12/1942 | Held | 220/88.1 |
| 2,973,295 | A * | 2/1961 | Rodgers, Jr. | 428/160 |
| 4,013,190 | A * | 3/1977 | Wiggins et al. | 220/501 |
| 4,394,669 | A * | 7/1983 | Ozawa et al. | 347/86 |
| 5,509,140 | A * | 4/1996 | Koitabashi et al. | 347/86 |
| 5,567,373 | A * | 10/1996 | Sato et al. | 264/112 |
| 5,657,065 | A * | 8/1997 | Lin | 347/93 |
| 5,815,184 | A * | 9/1998 | Ujita et al. | 347/87 |
| 5,817,704 | A * | 10/1998 | Shiveley et al. | 521/63 |
| 6,137,512 | A * | 10/2000 | Higuma et al. | 347/86 |
| 6,663,234 | B2 * | 12/2003 | Roof et al. | 347/86 |
| 6,746,110 | B2 * | 6/2004 | Hayashi | 347/86 |
| 6,809,047 | B2 * | 10/2004 | Lebold et al. | 442/392 |
| 6,827,431 | B2 * | 12/2004 | Kitabatake et al. | 347/86 |
| 7,661,790 | B2 * | 2/2010 | Harada et al. | 347/36 |
| 7,888,275 | B2 * | 2/2011 | Ward et al. | 442/353 |
| 2002/0101473 | A1 * | 8/2002 | Yearout | 347/36 |
| 2004/0051755 | A1 * | 3/2004 | Kanamitsu et al. | 347/36 |
| 2008/0136864 | A1 * | 6/2008 | Nakamura et al. | 347/30 |
| 2008/0318025 | A1 | 12/2008 | Kurokawa et al. | |
| 2009/0179941 | A1 * | 7/2009 | Harada et al. | 347/31 |

FOREIGN PATENT DOCUMENTS

| | | |
|---|---|---|
| JP | 2000-135797 | 5/2000 |
| JP | 2007-152881 | 6/2007 |
| JP | 2007-185928 | 7/2007 |
| JP | 2008-213467 | 9/2008 |

* cited by examiner

*Primary Examiner* — Matthew Luu
*Assistant Examiner* — Alexander D Shenderov
(74) *Attorney, Agent, or Firm* — Workman Nydegger

(57) ABSTRACT

A liquid absorption member includes a jointed body in which a plurality of cells are provided between partition members by jointing a plurality of the partition members with each other, and a liquid holding material which is filled into the cell and holds liquid. A plurality of diffusion paths in which attached liquid is diffused and flows are configured in the partition member, and a density of the partition member is a lower density than a density of the liquid holding material.

9 Claims, 7 Drawing Sheets

LIQUID ABSORPTION MEMBER AND PRINTER INCLUDING LIQUID ABSORPTION MEMBER

BACKGROUND

1. Technical Field

The present invention relates to a liquid absorption member and a printer including the liquid absorption member.

2. Related Art

In general, for example, a waste liquid tank which stores ink discharged from a print head is provided in a printer. There are many types including a liquid absorption member which retains the ink in the inner portion of the waste liquid tank. As the liquid absorption member, for example, there are liquid absorption members disclosed in JP-A-2000-135797 and JP-A-2008-213467. In JP-A-2000-135797, a liquid absorption member in which synthetic fiber sheets are configured so as to be laminated to one another in layers is disclosed, and in JP-A-2008-213467, a liquid absorption member in which porous materials having lower density than the substrate sheet are fitted is disclosed.

However, in recent years, in printers, there has been a printer of the type which uses a pigment ink. Compared to a dye ink which uses dye, generally, permeability and diffusibility of the pigment ink with respect to a liquid absorption member are more deteriorated. Thereby, when the pigment ink is attached onto the surface of the liquid absorption member, there is a case where some of the attached pigment ink does not permeate into the inner portion and the state where the ink is attached on the surface is maintained. In this case, the pigment ink is solidified on the surface of the liquid absorption member, and there is a problem in that diffusion of the ink is inhibited.

In addition, also in the inner portion of the liquid absorption member, the pigment ink which is held by the liquid absorption member is solidified; accordingly, in some cases, there is a problem in that diffusion of the ink is inhibited. However, even though referring to technologies described in JP-A-2000-135797 and JP-A-2008-213467, it is difficult to secure permeability and diffusibility of the pigment ink.

SUMMARY

An advantage of some aspects of the invention is to provide a liquid absorption member and a printer including the liquid absorption member capable of securing permeability and diffusibility of a pigment ink.

According to an aspect of the invention, there is provided a liquid absorption member which absorbs liquid including a jointed body which is configured by jointing a plurality of partition members and in which cells are provided between adjacent partition members, and a liquid holding material which is filled into the cells and retains liquid, wherein a plurality of diffusion paths in which liquid attached to the plurality of partition members is diffused and flows are configured in the jointed body, and a density of the partition member is provided so as to be lower than a density of the liquid holding material.

When configured in this manner, the diffusion paths in which liquid attached to the partition members is diffused and flows are configured in the jointed body. In addition, the density of the partition member is provided so as to be a lower density than the density of the liquid holding material. Thereby, the ink which is attached to the partition member satisfactorily permeates to the partition member, and can be diffused over the entire liquid absorption member. Therefore, even though the liquid is attached to the liquid absorption member, the following disadvantages can be decreased by the aspect of the invention: remaining of the liquid in specific places without permeation and diffusion in the liquid is generated, the accumulated liquid is solidified, and permeability and diffusibility are deteriorated.

Particularly, when the liquid is a pigment ink, the permeability and the diffusibility of the pigment ink are more deteriorated than those of the dye ink, and the pigment ink is attached on the surface of the liquid absorption member and solidified. However, as described above, when the jointed body is configured of the partition member and the diffusion path is configured by the partition member having lower density than that of the liquid holding material, the permeability and the diffusibility of the pigment ink with respect to the partition member can be satisfactorily achieved, and the solidification of the pigment ink which remains at the places in which the pigment ink is attached and deterioration of the permeability and the diffusibility of the pigment ink can be prevented.

In the liquid absorption member according to the aspect of the invention, the density of the liquid holding material which is filled into one cell may be different with respect to the density of the liquid holding materials which are filled into the other cells.

In the liquid absorption member according to the aspect of the invention, the plurality of cells may be arranged in one direction, and the density of the liquid holding material which is filled into the cell may be increased toward the one direction.

In the liquid absorption member according to the aspect of the invention, the size of one cell may be different with respect to the size of the other cells.

In the liquid absorption member according to the aspect of the invention, the plurality of cells may be arranged in one direction, and the sizes of the cells may be increased toward the one direction.

In the liquid absorption member according to the aspect of the invention, the plurality of partition members may include a first partition member in which unevenness is extended so as to be repeated in a predetermined direction, and a second partition member in which unevenness is extended so as to be repeated in a predetermined direction.

In the liquid absorption member according to the aspect of the invention, the first partition member and the second partition member may be laminated to each other.

In the liquid absorption member according to the aspect of the invention, a planar third partition member may be disposed between the first partition member and the second partition member.

In the liquid absorption member according to the aspect of the invention, the repeated direction of the unevenness in the first partition member may be different with respect to the repeated direction of the unevenness in the second partition member.

In the liquid absorption member according to the aspect of the invention, the density of the liquid holding material may be different from that of the partition member due to a fact that the positions of the liquid holding materials with respect to the partition member are different.

When configured in this manner, the densities of the liquid holding materials are not uniform, and the densities are different when the positions of the liquid holding materials with respect to the partition member are different. Thereby, a difference in the holding force of the liquid can be generated according to the position of the liquid holding material, and the portion which is relatively rapidly saturated with the ink and delivers the ink to other portions of the liquid holding material, and the portion which is slow to be saturated with the ink which holds much delivered ink can be provided. Moreover, according to the difference of the density, it is possible to spread the liquid over the entire liquid absorption member.

In the liquid absorption member according to the aspect of the invention, the density of the outer edge of the region of at least a portion of the liquid holding material may be configured so as to be greater than that of the other portions.

When configured in this manner, in the outer edge in which the density is set so as to be greater than that of other portions in the liquid holding material, the capillarity greatly acts, and lots of ink can be held. Thereby, diffusion of the liquid toward the outer edge side can be performed, and it is possible to spread the ink over the entire liquid absorption member.

In the liquid absorption member according to the aspect of the invention, a first partition member among the plurality of partition members may extend in parallel to a plane along a predetermined traveling direction while repeating approaching and separating along the predetermined traveling direction, a second partition member among the plurality of partition members may extend in parallel to a plane along a predetermined traveling direction while repeating approaching and separating along the direction perpendicular to the predetermined traveling direction, and the longitudinal direction of the liquid holding material which is filled into the cells in which the first partition member becomes a component and the longitudinal direction of the liquid holding material which is filled into the cells in which the second partition member becomes a component may be provided so as to be perpendicular to each other.

When configured in this manner, the longitudinal direction of the liquid holding material which is filled into the cells in which the first partition member becomes a component and the longitudinal direction of the liquid holding material which is filled into the cells in which the second partition member becomes a component may be provided so as to be perpendicular to each other, and compared to the case where all cells and liquid holding materials extend in the same direction, the operating head pressure can be decreased, and leakage of the liquid can be suppressed when the absorption member is inclined.

In the liquid absorption member according to the aspect of the invention, due to the fact that the position of the cells with respect to the partition member are different, the sizes of the cells can be configured so as to be different.

When configured in this manner, since the sizes of the cells according to the positions with respect to the partition members are different, the head pressure which affects the liquid holding material can be changed, and the amount of the liquid which is held by the liquid holding material can be changed. Thereby, the portion which is relatively rapidly saturated with the liquid and delivers the liquid to other portions of the liquid holding material, and the portion which is slowly saturated with the liquid and which holds much delivered liquid can be provided. Moreover, according to the difference of the holding state, it is possible to spread the liquid over the entire liquid absorption member.

According to another aspect of the invention, there is provided a printer which includes the above-described liquid absorption member.

When configured in this manner, the diffusion paths in which liquid attached to the partition members is diffused and flows are configured in the jointed body. In addition, the density of the partition member is provided so as to be a lower density than the density of the liquid holding material. Thereby, the liquid which is attached to the partition member satisfactorily permeates to the partition member, and can be diffused over the entire liquid absorption member. Therefore, even though the liquid is attached to the liquid absorption member, the following disadvantages can be decreased by the aspect of the invention: remaining of the liquid in specific places without permeation and diffusion in the liquid is generated, the accumulated liquid is solidified, and permeability and diffusibility are deteriorated.

Particularly, when the liquid is a pigment ink, the permeability and the diffusibility of the pigment ink are more deteriorated than those of the dye ink, and the pigment ink is attached to the surface of the liquid absorption member and solidified. However, as described above, when the jointed body is configured of the partition member and the diffusion path is configured by the partition member having lower density than that of the liquid holding material, the permeability and the diffusibility of the pigment ink with respect to the partition member can be satisfactorily achieved, and the remaining of the pigment ink at the places in which the pigment ink is attached and deterioration of the permeability and the diffusibility of the pigment ink can be prevented.

In the printer according to the aspect of the invention, the printer may include a print head and a waste liquid tank which stores ink discharged from the print head, wherein the above-described liquid absorption member may be disposed in the waste liquid tank.

In the printer according to the aspect of the invention, a discharging tube which discharges ink may be provided to the waste liquid tank, and the density of the liquid holding material which is filled into the plurality of cells arranged in one direction may be increased toward the one direction which is separated from the discharging tube in the liquid absorption member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a liquid absorption member 10 according to an embodiment of the invention and a printer 30 including the liquid absorption member 10 will be described with reference to drawings.

1. Configuration of Liquid Absorption Member 10

Figure 1:
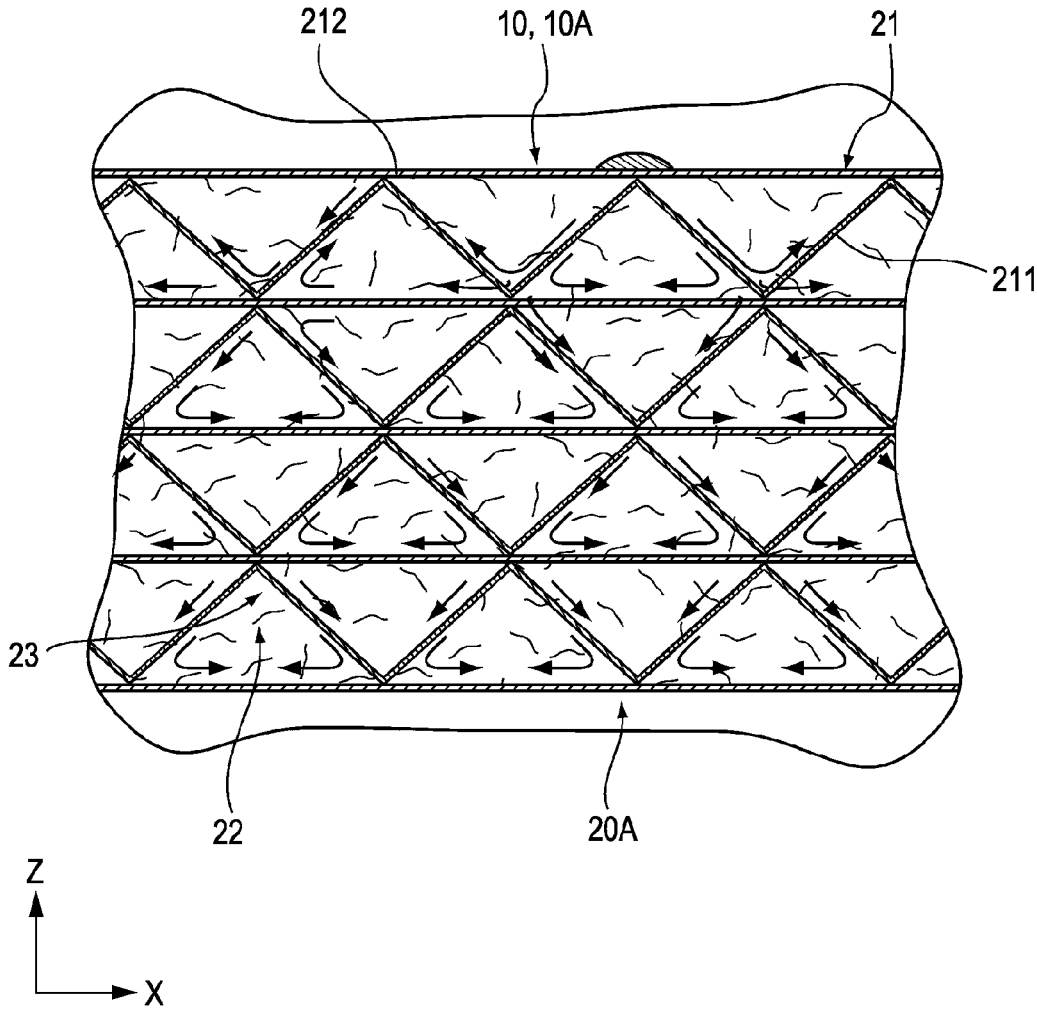
FIG. 1 is a side cross-sectional view showing a configuration of a liquid absorption member according to an embodiment of the invention.
Figure 2:
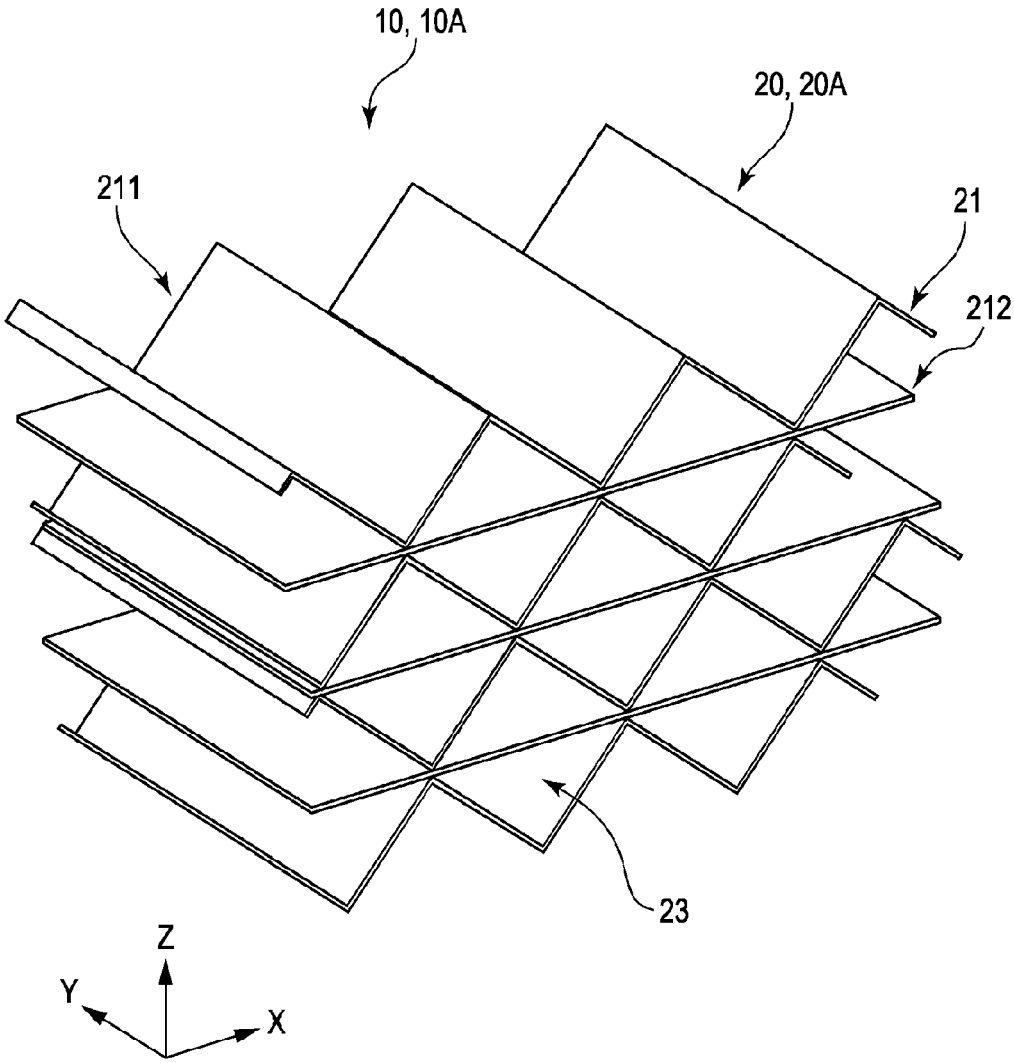
FIG. 2 is a perspective view showing a configuration of a jointed body in the liquid absorption member of FIG. 1.

FIG. 1 is a side cross-sectional view showing a configuration of the liquid absorption member 10A. In addition, FIG. 2 is a perspective view showing a configuration of a jointed body 20A in the liquid absorption member 10A. The liquid absorption member 10A includes a jointed body 20A and a liquid holding material 22. Among these, the jointed body 20A is configured by jointing partition members 21. The partition member 21 is a portion which also functions as a framework of the liquid absorption member 10A. The partition member 21 includes a function which causes ink (corresponding to an example of liquids referred to in aspects of the invention) flow while diffusing the ink. That is, when the ink is attached to the partition member 21, the ink gets into (permeates) the inner portion of the partition member 21, and the ink can flow in the inner portion of the partition member 21. In other words, compared to the liquid holding material 22, the ink easily permeates and flows in the partition member 21.

As shown in FIG. 1, the partition member 21 functions as a diffusion path which diffuses the ink and causes it to flow. As is clear from FIG. 1, the partition member 21 includes a plurality of diffusion paths, and diffuses so as to spread the ink attached to the partition member 21 throughout the entire jointed body 20A (liquid absorption member 10). In addition, in FIG. 1, flows of the ink in the partition member 21 are indicated by arrows. However, the direction in which the ink flows is not limited to the arrows, and the ink may flow in directions other than the arrows.

Moreover, the ink which permeates the partition member 21 and easily flows includes not only a dye ink but also a pigment ink. Particularly, in many cases, the pigment ink does not permeate to the liquid absorption member in the related art and is solidified on the surface. However, in the embodiment, the pigment ink permeates the partition member 21 and easily flows. Moreover, in general, a surface tension of the ink such as the pigment ink is weaker compared to water or the like, and therefore, the pigment ink has a characteristic in which the ink easily diffuses into the inner portion of the partition member 21. Thereby, the ink entering the inner portion of the partition member 21 can be satisfactorily diffused into the inner portion of the partition member 21.

In addition, as shown in FIGS. 1 and 2, the partition member 21 may be bent (uneven sheet body 211) so that unevenness is present in a sheet-like substrate and be a planar sheet body (flat sheet-like body 212). In the configuration shown in FIGS. 1 and 2, the jointed body 20A is configured due to the fact that the uneven sheet body 211 and the flat sheet-like body 212 are alternately laminated to each other in the lamination direction (Z direction). In the jointed body 20A shown in FIGS. 1 and 2, if all uneven sheet bodies 211 proceed along a predetermined traveling direction (X direction) perpendicular to the lamination direction (Z direction), the uneven sheet bodies are extended in parallel in an XY plane (plane along the traveling direction referred to in aspects of the invention) while unevenness (approaching and separating) is repeated with respect to the predetermined traveling direction (X direction).

Figure 3:
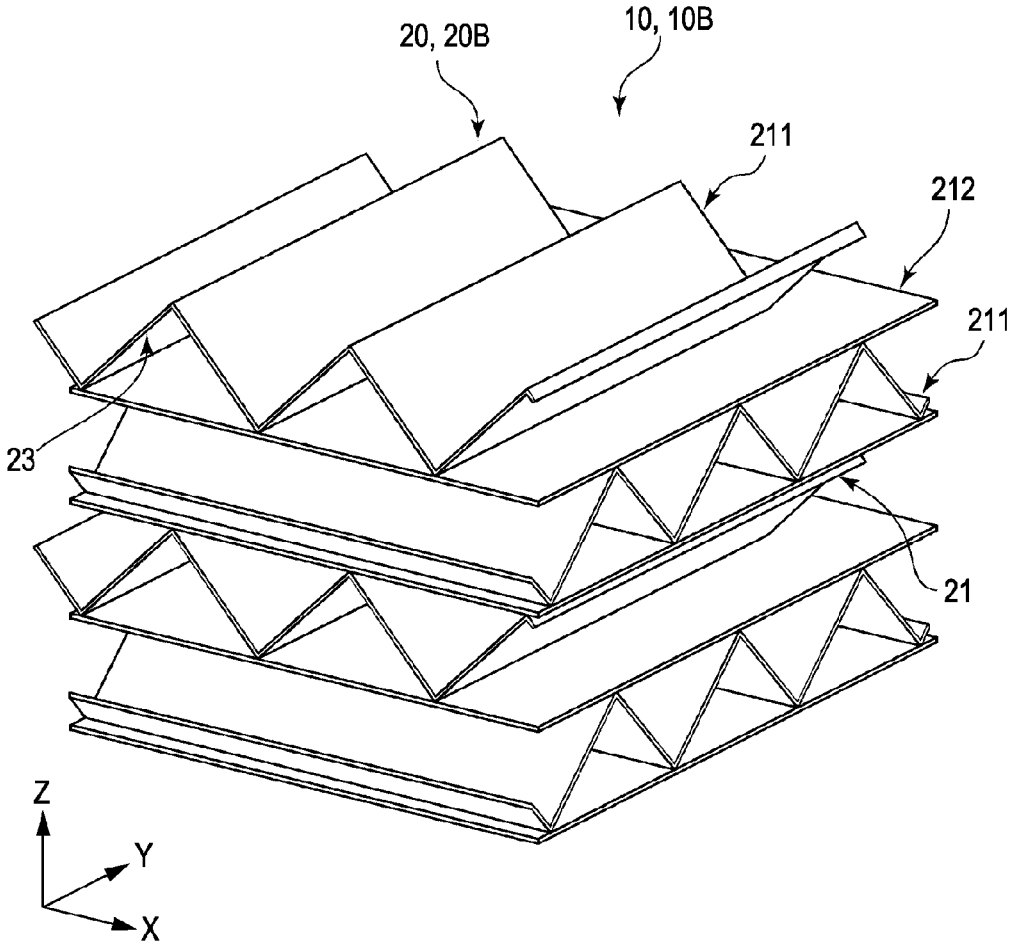
FIG. 3 is a perspective view showing the liquid absorption member in which extended directions of cells for each layer are different.

However, a jointed body 20B may be configured as shown in FIG. 3. In the jointed body 20B of the liquid absorption member 10B shown in FIG. 3, the uneven sheet body 211 in which unevenness (approaching and separating) is repeated along the X direction and which is extended in parallel in the XY plane, the uneven sheet body 211 in which unevenness (approaching and separating) is repeated along a Y direction perpendicular to the X direction and the Z direction and which is extended in parallel in the XY plane are adjacent to each other in the lamination direction (Z direction) while interposing the flat sheet-like body 212.

Moreover, in description below, when it is not necessary to particularly classify the liquid absorption members 10A to 10G of each aspect and these are referred to collectively, the liquid absorption members are simply referred to as the liquid absorption member 10, and when it is not necessary to particularly classify jointed bodies 20A to 20G and these are referred to collectively, the jointed bodies are simply referred to as the jointed body 20. In addition, when it is not necessary to particularly classify uneven sheet bodies 211, 211A, and 211G and these are referred to collectively, the uneven sheet bodies 211 are simply referred to as the uneven sheet body 20, and when it is not necessary to particularly classify flat sheet-like bodies 212 and 212C and these are referred to collectively, the flat sheet-like bodies are simply referred to as the flat sheet-like body 212.

Here, in the configuration shown in FIGS. 1 to 3, a small compartment (cell 23) which is a portion enclosed by the partition member 21 is provided in an elongated shape in which one direction becomes longitudinal. In addition, when the cell 23 is viewed from a direction perpendicular to the longitudinal direction of the cell 23, the shape or the cross-sectional shape of the cell 23 has a triangle.

Figure 4:
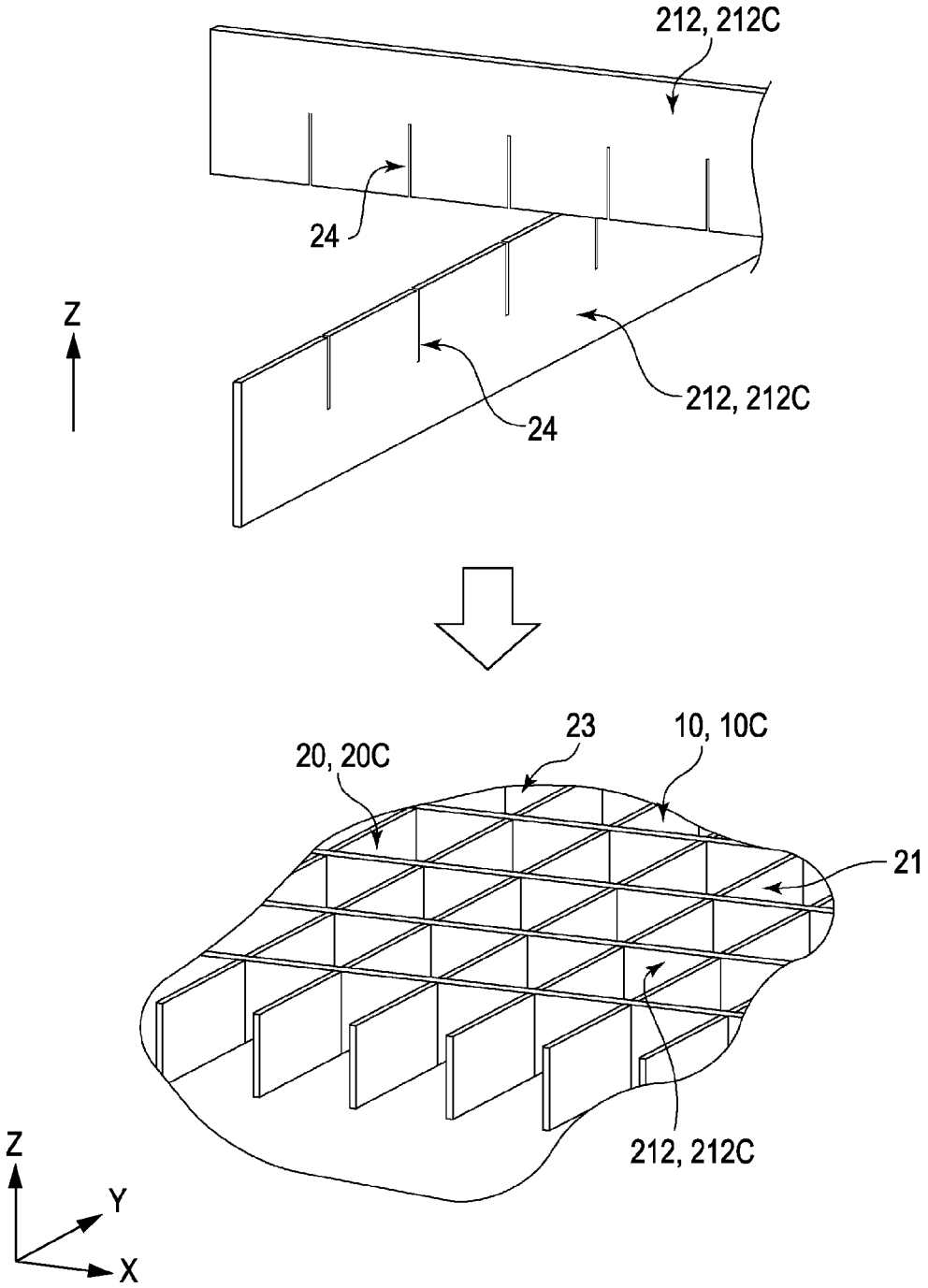
FIG. 4 is a perspective view showing the liquid absorption member according to insertion of the flat sheet-like body.

Moreover, the configuration of the jointed body 20 is not limited to the configurations of FIGS. 1 to 3. For example, like a liquid absorption member 10C shown in FIG. 4, slits 24 are formed in the flat sheet-like body 212C, the jointed body 20C may be configured due to the fact that the flat sheet-like bodies 212C are inserted into each other through the slits 24. Moreover, in the jointed body 20C shown in FIG. 4, the flat sheet-like bodies 212C in which the slits 24 are not present may be jointed to the periphery of one which is configured due to the fact that the flat sheet-like bodies 212C are inserted into each other. In addition, the jointed body 20 shown in FIG. 4 may be further laminated in the Z direction, and larger jointed body 20C may be configured. Moreover, the flat sheet-like body 212C in which the slits 24 are not present may be positioned between the laminated jointed bodies 20C.

Figure 5:
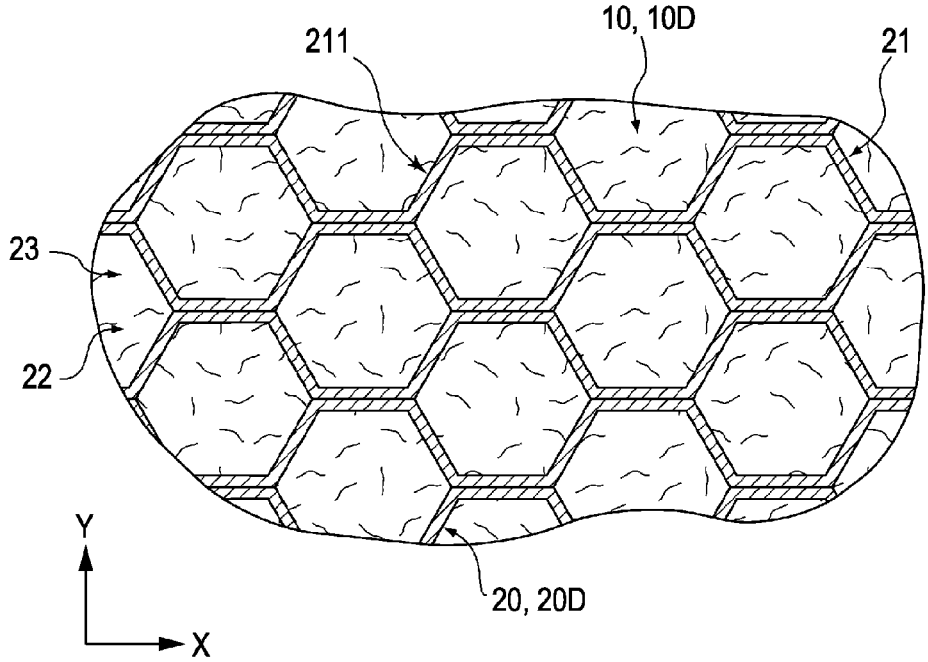
FIG. 5 is a side cross-sectional view showing a liquid absorption member which includes honeycomb cells.

In addition, the configuration of the jointed body 20 may be a configuration shown in FIG. 5. In the configuration of the liquid absorption member 10D shown in FIG. 5, the jointed body 20D is provided in a honeycomb shape. Moreover, in the configuration shown in FIG. 5, two uneven sheet bodies 211 are jointed to each other, and therefore, a hexagonal cell 23 is formed. In addition, the jointed body 20D shown in FIG. 5 is further laminated in the Z direction, and larger jointed body 20D may be configured. Moreover, when a honeycomb jointed body 20D is formed, unlike the one shown in FIG. 5, the jointed body may be formed due to the fact that the partition member 21 is formed in a hexagonal cylindrical shape and the partition members 21 having the hexagonal cylindrical shape are jointed to one another. In addition, the honeycomb shape may be formed due to the fact that the partition member 21 is formed in a cylindrical shape and a plurality of partition members 21 having a cylindrical shape are gathered and crushed.

Moreover, the shape of the jointed body 20 may include various configurations other than those shown in FIGS. 1 to 5. As the other configurations, when the cell 23 is viewed from the side surface, the shape of the cell may be a polygonal shape, a circular shape, an elliptical shape, an oblong shape, a wave-like shape, other irregular shapes, and combinations thereof. Moreover, the shape of the cell 23 in stereoscopic view may be a polyhedral shape including a regular polyhedron, and the others, may be a spherical shape, various curved surface shapes, other irregular shapes, and combinations thereof.

2. Material of Liquid Absorption Member 10

Next, a material of the liquid absorption member 10 will be described. As the partition member 21 which configures the above-described jointed body 20, it is necessary to include (1) a function which permeates the ink including the pigment ink, (2) a function which diffuses the entered a pigment ink, and (3) a function which maintains the shape of the liquid absorption member 10. The partition member 21 may be a material which has a lower density than the liquid holding material 22 and has an affinity for ink. In addition, a plurality of voids are present in the inner portion of the partition member 21, and the state where the density of the partition member is lower than that of the liquid holding material 22 is achieved by the existence of the voids. As the material of the partition member 21, there are pulpwood using cellulose fibers, nonwoven fabric using various fibers, resin foams and have permeability to ink, a sintered body having permeability to ink, and the like.

Here, for example, the pulpwood using cellulose fibers includes wood pulp, linters, non-wood pulp, waste paper pulp, rayon pulp, or mixtures thereof. In addition, the pulps may be either of mechanical pulp or chemical pulp. Moreover, the nonwoven fabric using various fibers includes aramid fibers, glass fibers, cellulose fibers, nylon fibers, vinylon fibers, polyester fibers, polyolefin fibers, rayon fibers, one in which thermoplastic resin is formed in the form of nonwoven fabric (for example, those in which low-density polyethylene resin, ethylene-vinyl acetate resin, synthetic rubber, polyamide copolymer resin, and copolymerized polyester resin are formed in the form of nonwoven fabric), or one which use mixtures thereof as the material.

Moreover, the material which is a resin foam and has permeability to ink may include one using various polymeric foams. However, among the foams, since ink does not permeate a closed cell foam body, an opened cell foam body in which air bubbles are connected to one another is needed. The opened cell foam body may include an opened cell foam body of thermoplastic polyurethane, an opened cell foam body of removed calcium carbonate and polyolefin, nitrile rubber sponge, an opened cell foam body of chemical foam and thermoplastic resin in which a foaming agent is added to a thermoplastic resin, a mechanical foam body rubber sponge of a rubber latex, a chemical foam body of polyvinyl chloride paste, or the like.

In addition, as the sintered body having permeability to ink, there is a porous opened cell foam body which is formed by sintering, and for example, the sintered body may include an opened cell foam body of porous ceramics, an opened cell foam body of porous metal, an opened cell foam body in which various types of resin powder are sintered, or the like.

Moreover, the liquid holding material 22 is filled into the cell 23 which is present in the above-described jointed body 20. The liquid holding material 22 is a portion into which the ink, which permeates to the partition member 21 and flows in the partition member 21, enters, and a portion which holds the entered ink. Thereby, the liquid holding material 22 is required to include a function which holds the ink, and it is preferable that the held ink not be returned again to the partition member 21 in a state where the ink is not saturated. Thus, in the embodiment, the density of the liquid holding material 22 is set to be greater than the density of partition member 21, and it is preferable that capillarity of the liquid holding material which acts on the permeated liquid be greater than that of the partition member 21.

However, it is preferable that a polymer absorbent be used as the liquid holding material 22. In this case, it is preferable that the density of the liquid holding material 22 be a lower density than that of the partition member 21.

Moreover, it is preferable that the liquid holding material 22 comes into contact with the partition member 21 in various directions. In the case of the contacting, the ink which flows in the partition member 21 can satisfactorily enter the liquid holding material 22. However, taking into consideration swelling of the liquid holding material 22 after the liquid holding material absorbs the ink, a slight gap may exist between the liquid holding material 22 and the partition member 21.

As the material which configures the liquid holding material 22, any one of various materials which can be used as the above-described partition member 21, or combinations thereof may be used. Here, considering the function of the liquid holding material 22 which holds the ink, when the liquid holding material 22 is configured of the above-described materials, it is preferable that the density of the material be higher than the case where the partition member 21 is configured of the same material. Moreover, it is preferable that the material of the partition member 21 be the same as the material of the liquid holding material 22. In the case where the materials of both are the same as each other, it is necessary that the density of the liquid holding material 22 is higher than that of the partition member 21.

In addition, the material which configures the liquid holding material 22 may include materials other than the above-described those. As the materials, there is water absorption resin or high water absorption resin. Here, the water absorption resin or the high water absorption resin may include starch-based ones (for example, starch-acrylonitrile graft copolymer, starch-acrylic acid graft copolymer, starch-acrylamide graft copolymer, or the like), cellulose-based ones (for example, cellulose acrylonitrile graft copolymer, cross-linked carboxymethyl cellulose, or the like), other polysaccharides (for example, hyaluronic acid, or the like), polyvinyl alcohol-based ones (for example, cross-linked polyvinyl alcohol, frozen and thawed elastomer of polyvinyl alcohol water gel, or the like), acrylic acid-based ones (for example, sodium acrylic-vinyl alcohol copolymer, cross-linked sodium polyacrylate, or the like), and acrylamide based-ones (for example, cross-linked N-substituted acrylamide, or the like).

3. Other Original Matters

Next, in the above-described liquid absorption member 10, original matters other than the above-described will be described. Moreover, in the description below, the case where the height direction is the Z direction is described. However, in the direction in which the liquid absorption member 10 is installed, the height direction is not limited to the Z direction, and the height direction may be the X direction or the Y-direction.

1. Original Matter in Aspect of Size

First, the original matter in the aspect of the size of the absorption member 10 will be described. In the liquid absorption member in the related art, the liquid absorption member is configured according to the liquid holding material 22. Thereby, in the liquid absorption member in the related art, head pressure is increased, and the volume of the ink which can be held with respect to the volume of the liquid absorption member is decreased.

In contrast, as described above, in the liquid absorption member 10 of the embodiment, a plurality of cells 23 are provided, and the liquid holding material 22 is filled into the each cell 23. Thereby, the head pressure which acts on each liquid holding material 22 is significantly smaller than that of the liquid absorption member in the related art. Particularly, in the embodiment, decrease in size in the height direction (Z direction) of the liquid holding material 22 contributes to a proportion of the volume of the ink which can be held with respect to the volume of the liquid absorption member 10 being enhanced. As the size, it is preferable that the size in the height direction (Z direction) be 50 mm or less. However, if the size is too small, the frequency in which the liquid holding material 22 is filled into the cell 23 is increased, and therefore, there is a concern that deterioration in the productivity or the like may be generated. Thereby, the size in the height direction (Z direction) of the cell 23 preferably is 5 mm or more, more preferably is 10 mm or more, and most preferably is 25 mm or more.

In addition, when the liquid absorption member 10 is inclined, in order to secure the function which holds the ink, it is preferable that the size of the liquid absorption member 10 in the direction (X direction or Y direction) perpendicular to the height direction (Z direction) be the same as the size in the height direction (Z direction) described above. However, considering that the state where the liquid absorption member 10 is inclined occurs less, each size in the directions (X direction or Y direction) perpendicular to the height direction (Z direction) among the sizes of the liquid absorption member 10 may be greater than the size in the height direction (Z direction).

2. Original Matter in Aspect of Density

Figure 6:
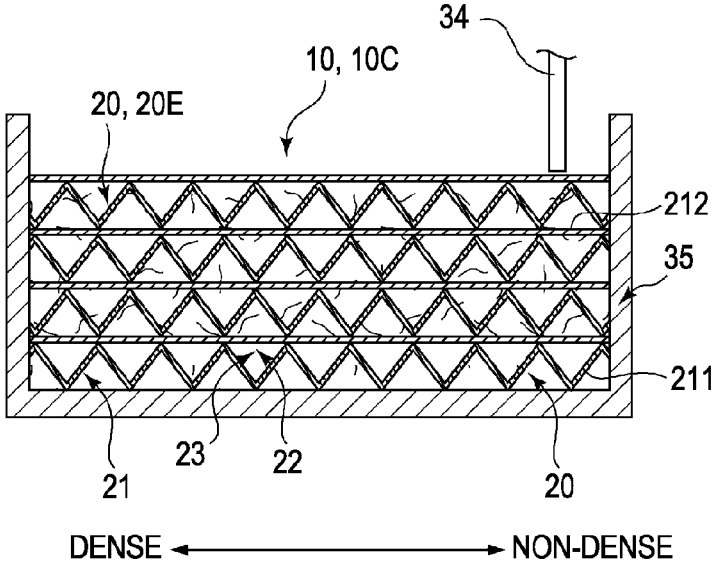
FIG. 6 is a side cross-sectional view showing the liquid absorption member in which a density of a partition member is changed.

Next, the original matter in the aspect of the density of the liquid absorption member 10 will be described. As shown in FIG. 6, the liquid absorption member 10E is installed in the inner portion of a waste liquid tank 35 which is provided in the printer 30. However, in general, an ink discharging tube 34 which discharges the ink, which is waste liquid, to the waste liquid tank 35 is disposed so as to lean toward one end side of the waste liquid tank 35. Therefore, the jointed body 20E may be configured so that the density of the partition member 21 is increased toward the other end side separating from a point in which the ink discharged from the ink discharging tube 34 is firstly attached. Accordingly, since the density of the one end side of the partition member 21 is a lower density than that of the other end side, compared to the case where the ink reaches the other end side, it is difficult to hold the ink, which is attached to the one end side, in the attached portion, and the ink flows toward the other end side having greater capillarity. Thereby, the ink can flow toward the other end side in the inner portion of the partition member 21, and it is possible to enhance the diffusibility of the ink.

Moreover, FIG. 6 shows the case where the ink discharging tube 34 is disposed so as to lean toward the one end side in the X-direction. In addition, it is preferable that the density of the partition member 21 be increased with greater separation from the attached portion of the ink. Thereby, the invention is not limited to the case where the density is increased from one end side toward other end side, for example, the density of the partition member 21 may be increased in a wavy state about the attached portion of the ink.

Moreover, the density of the liquid holding material 22 may be configured so as to increase toward the other end side separating from the point in which the ink is firstly attached. Thereby, in the capillarity which acts on the inner portion of the liquid holding material 22, the capillarity of the other end side is greater than that of the one end side. Thereby, compared to the case where the density of the liquid holding material 22 is uniform, the ink flows more easily toward the other end side in which the holding force of the liquid holding material 22 is stronger rather than toward the one end side in which the holding force of the liquid holding material 22 is weaker. Therefore, it is possible to satisfactorily secure the holding property of the ink in the entire liquid absorption member 10E. Moreover, it is preferable that the density of the liquid holding material 22 be increased with increasing separation from the attached portion of the ink. Thereby, the invention is not limited to the case where the density is increased from one end side toward other end side, for example, the density of the liquid holding material 22 may be increased in a wavy state about the attached portion of the ink.

In addition, the densities of liquid holding materials 22 are configured so as to be different as the positions with respect to the partition member 21 are different. In this case, it is possible to spread the ink over the entire the liquid absorption member 10 due to the difference of the densities. In addition, in the embodiment, the density in the outer edge of the region of at least a portion of the liquid holding material 22 may be configured so as to be greater than those of the other portions. In this case, it is possible to diffuse the ink toward the outer edge side, and it is possible to spread the ink over the entire liquid absorption member 10.

In addition, in the density of the liquid member 22, the density of the center side which is separated from the outer edge side in the liquid absorption member 10 may be configured so as to be the highest. In this case, the greatest capillarity acts in the center side of the liquid absorption member 10, and lots of ink can be held in the center side.

Thereby, it is possible to make leakage of the ink to the outer edge side of the liquid absorption member 10 difficult. Moreover, the density of the liquid holding material 22 may be configured so that the density of the center side, which is separated from the outer edge side in the direction even in any one of the X direction, the Y direction, and the Z direction in the liquid absorption member 10, is the highest. However, in at the least one of the X direction, the Y direction, and the Z direction, the density of the center side which is separated from the outer edge side of the direction may be configured so as to have the highest density.

3. Ingenuity in Aspect of Size of Cell 23

Next, the original matter of the aspect in the sizes of the cells 23 of the liquid absorption member 10 will be described.

The head pressure which acts on each liquid holding material 22 becomes greater if the volume of the liquid holding material 22 is smaller even when the sizes in the height direction (Z direction) of the liquid holding materials 22 are the same as one another. Therefore, like a jointed body 20F of a liquid absorption member 1OF shown in FIG. 7, the volume of the cell 23 may be decreased toward the other end side when increasing separation from the point in which the ink is firstly attached.

Figure 7:
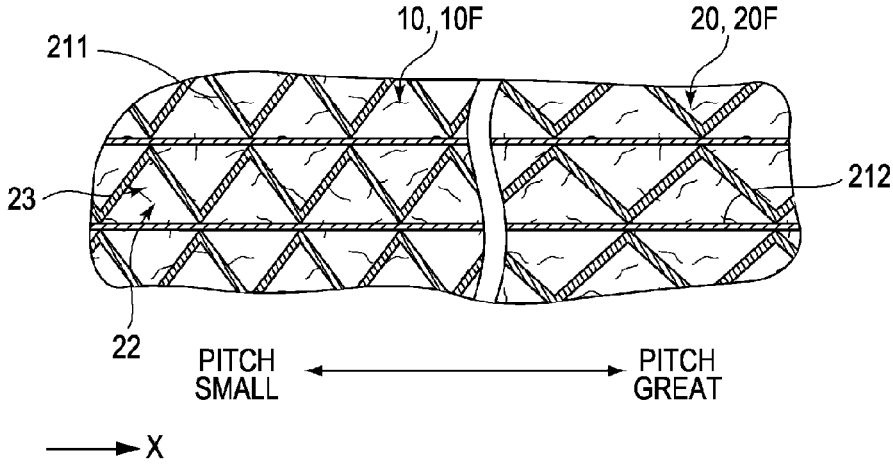
FIG. 7 is a side cross-sectional view showing the liquid absorption member in which pitch of the cells is changed.

FIG. 7 shows that the size (pitch in X direction) of the cell 23 is gradually decreased from one end side toward the other end side in the X direction. If the size of the cell is configured as described above, in the capillarity which acts on the inner portion of the liquid holding material 22, the capillarity of the other end side is greater than that of the one end side. Thereby, compared to the case where the density of the liquid holding material 22 is uniform, the ink more easily flows toward the other end side in which the holding force of the liquid holding material 22 is stronger rather than toward the one end side in which the holding force of the liquid holding material 22 is weaker. Therefore, it is possible to satisfactorily secure the holding property of the ink in the entire liquid absorption member 10.

In addition, the invention is not limited to the one shown in FIG. 7, and the sizes of the cells 23 may be configured so as to be different due to the fact the positions with respect to the partition member 21 are different. In this case, since the sizes of the cells 23 are different according to the position of the cells with respect to the partition member 21, the head pressure is changed by the size of the cell 23, and differences in the holding state of the ink are generated. Moreover, according to the difference of the holding state, it is possible to spread the ink over the entire liquid absorption member 10.

4. Ingenuity in Aspect of Disposition of Partition Member 21 and Liquid Holding Material 22

Figure 8:
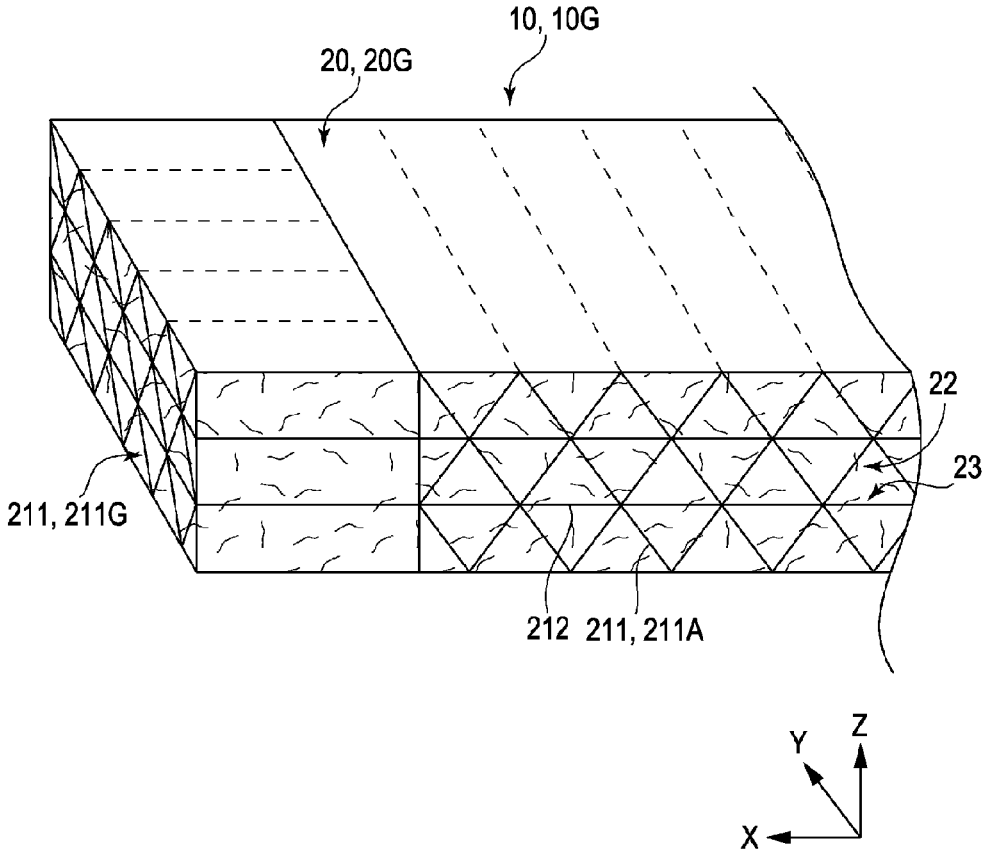
FIG. 8 is a perspective view showing the liquid absorption member in which directions in the cells of the other end side are different.

Next, the original matter in the aspect of the disposition of the partition member 21 and the liquid holding material 22 will be described. As shown in FIG. 8, the jointed body 20G of the liquid absorption member 10G includes an uneven sheet body 211A (corresponding to an example of first partition member referred to in aspects of the invention) in which unevenness (approaching and separating) is repeated along the X direction and which is extended in parallel in the XY plane, an uneven sheet body 211G (corresponding to an example of second partition member referred to in aspects of the invention) in which unevenness (approaching and separating) is repeated along a Y direction and which is extended in parallel in the XY plane. Thereby, the extended direction of the cell 23 which includes the uneven sheet body 211A as the component and the extended direction of the cell 23 which includes the uneven sheet body 211A as the component are perpendicular to each other, and the extended directions of the liquid holding materials 22 which are filled into each cell 23 are perpendicular to each other.

Moreover, compared to the uneven sheet body 211A, the sizes in the Y direction and the Z direction of the uneven sheet body 211G are the same. However, the size in the X direction is provided so as to be shorter.

When the liquid absorption member 10G is used, the diffusion direction of the ink is different in the other end side of the liquid absorption member 10E. Thereby, it is possible to further enhance diffusibility of the ink, and it is possible to enhance the holding force of the ink in the entire liquid absorption member 10G. Moreover, when all directions of the jointed body 20 and the liquid holding material 22 are the same as one another, there is a concern that the ink may leak due to influence of the a head pressure which acts when the liquid absorption member 10 is inclined. However, in the liquid absorption member 10E, since the uneven sheet body 211G, the cells 23, and the liquid holding material 22 are extended in the different directions, the head pressure which acts when the liquid absorption member 10G is inclined is decreased, and leakage of the ink can be prevented.

4. Printer 30 Including Liquid Absorption Member 10

Subsequently, a printer 30 which includes the above-described liquid absorption member 10 will be described. Moreover, in the description of the printer 30, portions which are related to the above-described liquid absorption member 10 are extracted and described.

Figure 9:
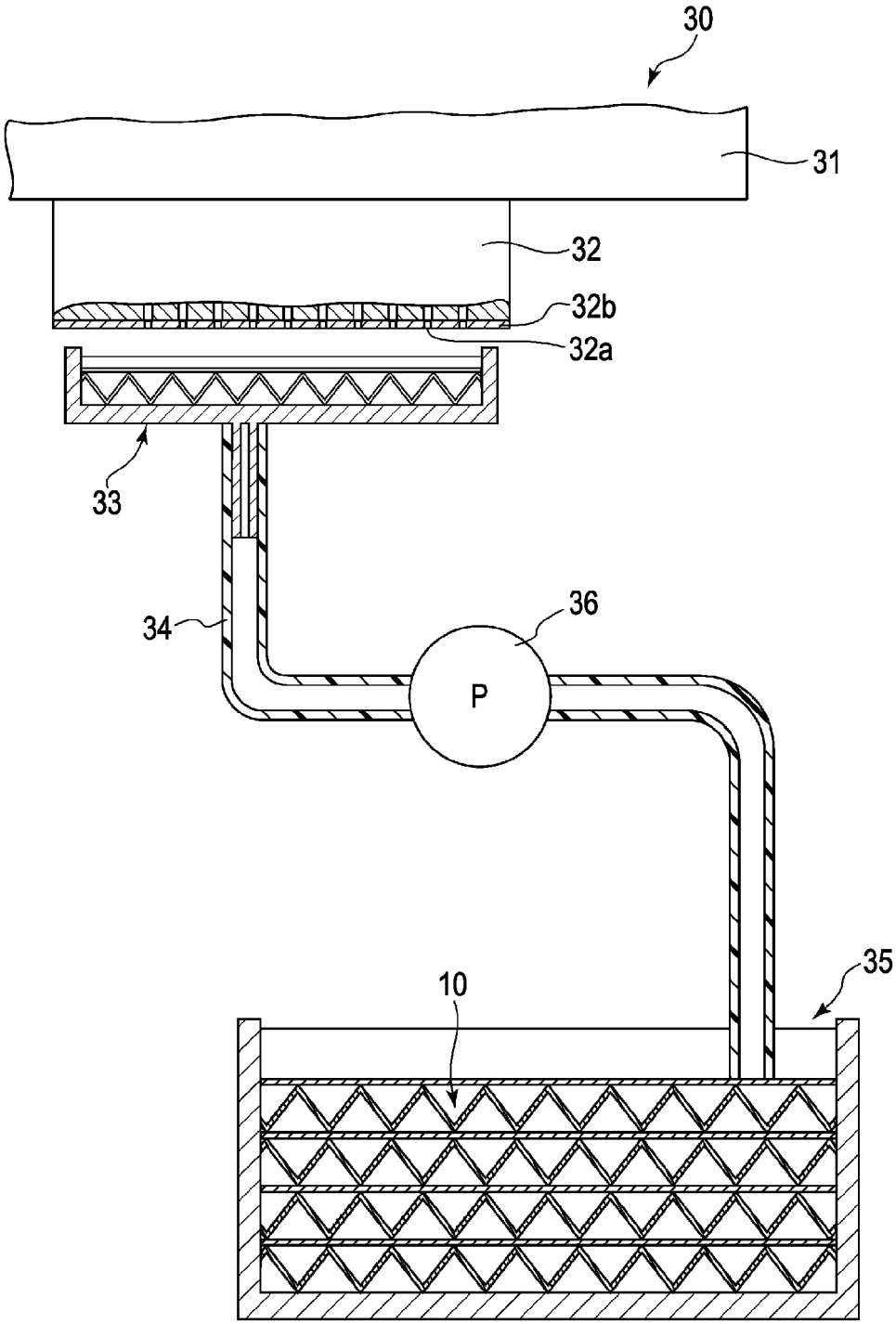
FIG. 9 is a view showing a schematic configuration between a carriage and a waste liquid tank of a printer.

FIG. 9 is a view showing a schematic configuration of portions which are related to the liquid absorption member 10 in the printer 30. The printer 30 includes a carriage 31, and an ink storage portion (not shown) is provided in the carriage 31. In a case of the printer 30 of the type (so-called on-carriage type) in which ink cartridges can be mounted on the carriage 31, the ink storage portion corresponds to the ink cartridge. Moreover, in the case of the printer 30 of the type (so called off-carriage type) in which ink cartridges are not mounted on the carriage 31, the above-described ink storage portion corresponds to a sub tank. Moreover, in the printer 30 of the embodiment, the ink cartridge in which at least a pigment ink is stored can be loaded.

A print head 32 is mounted on the carriage 31. The print head 32 ejects ink from nozzles 32*a* toward a printing medium. A nozzle formation substrate 32*b* is mounted on the lower surface side of the print head 32, and the opening portions of the nozzles 32*a* are exposed to a nozzle formation substrate 32*b*.

Moreover, a cap member 33 is disposed in the vicinity of a non-printing region of the print head 32. The cap member 33 abuts the nozzle formation surface and forms a sealed space. Therefore, the cap member 33 can be vertically lifted and lowered by a lifting and lowering mechanism (not shown).

Moreover, an end of the ink discharging tube 34 is connected to the cap member 33. The other end side of the ink discharging tube 34 is connected to the waste liquid tank 35. In addition, a suction pump 36 is provided in a middle portion of the ink discharging tube 34. Thereby, when the suction pump 36 is operated, the ink can be discharged from the nozzles 32*a* of the print head 32 toward the waste liquid tank 35. Moreover, the above-described liquid absorption member 10 is disposed in the waste liquid tank 35.

According to the above-described configuration, when the suction pump 36 is operated based on a control command of a control portion (not shown) and the ink is suctioned from the nozzles 32*a* or a flushing operation which ejects the inks from the nozzles 32*a* based on the control command of the control portion (not shown) is performed, the ink is discharged to the waste liquid tank 35 via the ink discharging tube 34. Moreover, the discharged ink is attached to the liquid absorption member 10 and absorbed by the liquid absorption member 10.

5. Effect in Embodiment

According to the liquid absorption member 10 and the printer 30 of the above-described configuration, a diffusion path which makes the liquid attached to the partition member 21 flow while diffusing the liquid is configured in the jointed body 20. Moreover, the density of the partition member 21 is provided so as to be a lower density than the density of the liquid holding material 22. Thereby, the ink which is attached to the partition member 21 satisfactorily permeates to the partition member 21, and can be diffused over the entire liquid absorption member 10. Therefore, even though the ink is attached to the liquid absorption member 10, the following disadvantages can be decreased by the invention: remaining of the ink in specific places without permeation and diffusion in the ink is generated, the accumulated ink is solidified, and permeability and diffusibility are deteriorated.

Particularly, when the ink is a pigment ink, the permeability and the diffusibility of the pigment ink are more deteriorated than those of the dye ink, and the pigment ink is attached to the surface of the liquid absorption member 10 and solidified. However, as described above, when the jointed body 20 is configured of the partition member 21 and the diffusion path is configured by the partition member 21 having lower density than that of the liquid holding material 22, the permeability and the diffusibility of the pigment ink with respect to the partition member 21 can be satisfactorily achieved, and the remaining of the pigment ink at the places in which the pigment ink is attached and deterioration of the permeability and the diffusibility of the pigment ink can be prevented.

Moreover, in the embodiment, due to the fact that the position of the liquid holding material 22 with respect to the partition member 21 is different, the density of the liquid holding material is configured so as to be different. When configured in this manner, the difference in the holding force of the ink is generated according to the position of the liquid holding material 22, and the portion which is relatively rapidly saturated with the ink and delivers the ink to other portions of the liquid holding material 22, and the portion which is slowly saturated with the ink and which holds much delivered ink can be provided. Moreover, according to the difference of the density, it is possible to spread the ink over the entire liquid absorption member 10.

In addition, in the embodiment, the density of the outer edge of the region of at least a portion of the liquid holding material 22 may be configured so as to be greater than that of the other portions. When configured in this manner, in the outer edge in which the density is set so as to be greater than that of other portions in the liquid holding material 22, the capillarity greatly acts, and lots of ink can be held. Thereby, diffusion of the ink toward the outer edge side can be performed, and it is possible to spread the ink over the entire liquid absorption member 10.

In addition, in the embodiment, the plurality of partition members 21 can be configured so as to include an uneven sheet body 211A (corresponding to an example of first partition member referred to in aspects of the invention) in which unevenness (approaching and separating) is repeated along the X direction and which is extended in parallel in the XY plane, an uneven sheet body 211G (corresponding to an example of second partition member referred to in aspects of the invention) in which unevenness (approaching and separating) is repeated along the Y direction and which is extended in parallel in the XY plane. When configured in this manner, since the longitudinal direction of the liquid holding material 22 which is filled into the cell 23 in which the uneven sheet body 211A becomes the component and the longitudinal direction of the liquid holding material 22 which is filled into the cell 23 in which the uneven sheet body 211G becomes the component are provided so as to be perpendicular to each other, compared to the case where all cells 23 and liquid holding materials 22 are extended in the same direction, the operating head pressure can be decreased. Moreover, when the liquid absorption member 10 is inclined, it is possible to suppress the ink from being leaked.

In addition, in the embodiment, due to the fact that the position of the cells 23 with respect to the partition member 21 are different, the sizes of the cells can be configured so as to be different. When configured in this manner, since the sizes of the cells 23 according to the position with respect to the partition member 21 are different, the head pressure which affects the liquid holding material 22 can be changed, and the amount of the ink which is held by the liquid holding material 22 can be changed. Thereby, the portion which is relatively rapidly saturated with the ink and delivers the ink to other portions of the liquid holding material 22, and the portion which is slowly saturated with the ink and which holds much delivered ink can be provided. Moreover, according to the difference of the holding state, it is possible to spread the ink over the entire liquid absorption member 10.

6. Modification

One embodiment of the invention is described above. However, the invention can be variously changed. Hereinafter, the modification will be described.

6-1 First Modification

The above-described embodiment is described with respect to the densities of the partition member 21 and the liquid holding material 22. However, instead of the density, proportions of bubbles or voids per unit volume may be used. In this case, particularly, proportions of the bubbles or voids in materials in which the specific gravities are different can be compared to each other.

6-2 Second Modification

Moreover, humectants such as glycerin may be provided on the bottom surface of the waste liquid tank 35 in the above-described embodiment. In this case, solidification of the ink can be suppressed by existence of the humectants, and it is possible to secure permeability and diffusibility of the partition member 21.

6-3 Third Modification

In addition, in the above-described embodiment, the conception of the printer 30 may include a fluid ejecting apparatus which ejects liquids other than the ink (liquid itself, liquid in which particles of functional materials are dispersed or mixed, and liquid which includes materials having fluidity such as a gel). The fluid ejecting apparatus may include a liquid ejecting apparatus for ejecting liquid including materials such as electrode materials or color materials (pixel materials), which are used for manufacturing a liquid crystal display, EL (electroluminescence) display, and a surface light emitting display, or the like, as a distributed or dissolved form; a liquid ejecting apparatus for ejecting bioorganic materials used in the manufacture of biochips; a fluid ejecting apparatus for ejecting liquid including samples used as a precision pipette; or the like.

6-4 Fourth Modification

In addition, the conception of the printer 30 of the invention includes a fluid ejecting apparatus for ejecting lubricating oil in precision machines such as watches or cameras by a pin point; a fluid ejecting apparatus for ejecting transparent resin solution such as an ultraviolet-curable resin for forming micro-hemispherical lens (optical lens) or the like used in optical communication elements or the like on a substrate; a fluid ejecting apparatus for ejecting etching solutions such as an acid or an alkali for etching substrates or the like; a fluid ejecting apparatus for ejecting a fluid such as a gel (for example, physical gel); or the like.

The entire disclosure of Japanese Patent Application No.2011-059066, filed Mar. 17, 2011 is expressly incorporated by reference herein.

What is claimed is:

1. A liquid absorption member comprising:

a jointed body in which a plurality of cells are provided between partition members by jointing a plurality of the partition members with each other; and a liquid holding material which is filled into the cells and holds liquid, wherein a plurality of diffusion paths in which attached liquid is diffused and flows are configured in the partition member, and a density of the partition member is a lower density than a density of the liquid holding material, wherein the size of one cell is different with respect to the size of the other cells, wherein the plurality of cells are arranged in a direction that is perpendicular to a height direction, and the density of the liquid holding material which is filled into the cells is increased in the direction perpendicular to the height direction.

2. The liquid absorption member according to claim 1, wherein the density of the liquid holding material which is filled into one cell is different with respect to the density of the liquid holding materials which are filled into the other cells.

3. The liquid absorption member according to claim 1, wherein the sizes of the cells are increased in the direction perpendicular to the height direction.

4. The liquid absorption member according to claim 1, wherein the plurality of partition members include a first partition member in which unevenness is extended so as to be repeated in a predetermined direction, and a second partition member in which unevenness is extended so as to be repeated in a predetermined direction.

5. The liquid absorption member according to claim 4, wherein the first partition member and the second partition member are laminated to each other.

6. The liquid absorption member according to claim 5, wherein a planar third partition member is disposed between the first partition member and the second partition member.

7. The liquid absorption member according to claim 4, wherein the repeated direction of the unevenness in the first partition member is different with respect to the repeated direction of the unevenness in the second partition member.

8. A printer comprising:

a print head; and a waste liquid tank which stores ink discharged from the print head, wherein the liquid absorption member according to claim 1 is disposed in the waste liquid tank.

9. The printer according to claim 8, wherein a discharging tube which discharges ink is provided to the waste liquid tank, and the discharging tube is provided at the corresponding area of low density of the liquid holding material.

* * * * *